US006112709A

United States Patent [19]

Chu

[11] Patent Number: 6,112,709

[45] Date of Patent: Sep. 5, 2000

[54] BOOSTING MECHANISM OF TWO-STROKE ENGINE

[76] Inventor: Yu-Po Chu, 5F, No. 11, Lane 233, Sec. 1, Tui-Hua South Rd., Taipei, Taiwan

[21] Appl. No.: 09/292,389

[22] Filed: Apr. 15, 1999

[51] Int. Cl.[7] ..... F02B 1/08

[52] U.S. Cl. ..... 123/73 AF; 123/559.1

[58] Field of Search ..... 123/73 AF, 559.1, 123/559.2

[56] References Cited

U.S. PATENT DOCUMENTS

| | | | |
|---|---|---|---|
| 4,289,094 | 9/1981 | Tanahashi et al | 123/73 AF |
| 4,445,336 | 5/1984 | Inoue | 123/559.1 |
| 5,224,459 | 7/1993 | Middlebrook | 123/559.1 |
| 5,293,846 | 3/1994 | Takahashi | 123/559.1 |
| 5,368,004 | 11/1994 | Mann | 123/559.1 |
| 5,887,675 | 3/1999 | Wheeler, Jr. et al. | 123/559.1 |

FOREIGN PATENT DOCUMENTS

| | | | |
|---|---|---|---|
| 0145806 | 11/1979 | Japan | 123/73 AF |

*Primary Examiner*—Marguerite McMahon
*Attorney, Agent, or Firm*—Varndell & Varndell, PLLC

[57] ABSTRACT

A boosting mechanism of two-stroke engine, including a turbo-propeller disposed on a mandrel of an activating shaft. The turbo-propeller is positioned in front of an intake port of the combustion chamber of an engine and coupled with a crank of the piston of the engine. By means of rotating the activating shaft, the turbo-propeller is rotated along the activating shaft. Also, the turbo-propeller is synchronously operated with the piston to sweep mixed gas into the combustion chamber so as to maintain a proper oil-gas ratio and increase gas pressure and enhance combustion efficiency and power of the engine.

4 Claims, 7 Drawing Sheets

BOOSTING MECHANISM OF TWO-STROKE ENGINE

BACKGROUND OF THE INVENTION

The present invention relates to a boosting mechanism of two-stroke engine, and more particularly to an activating lever disposed with a turbo-propeller in front of an intake port of the combustion chamber of an engine for enhancing the power of the engine. The present invention is applicable to the engines of various kinds of model cars or motorcycles.

It is known that the thermodynamic cycle of the working of an engine is generally composed of four strokes of intake, compression, explosion and exhaustion. Such cycle is employed by most of the cars. However, such four strokes necessitate multi-cylinder engine which needs higher cost and large space.

A two-stroke engine employs single cylinder to accomplish the functions of intake, compression, explosion and exhaustion. These four steps are performed during two-time reciprocation of the piston so that the efficiency is poorer than that of the tour-stroke engine. However, it is easier to increase the power of the engine so as to increase the average working pressure of the working gas. The rear end of the conventional activating lever of the engine is disposed with a small tray formed with a notch for coupling with a crank. After activated, the activating lever has no other function benefiting the intake. Therefore, the two-stroke engine generally employs a crank case for sweeping the gas. In operation of such engine, the lubricant oil in the crank case may be guided into the cylinder to affect the combustion efficiency. Moreover, the crank in the crank case sweeps the gas linearly so that the working gas flows into the combustion chamber in a straightly linear manner. The working pressure value of the gas is not high. Moreover, the gap between the crank and the wall of the crank case is limited by the profile of the crank case so that a sealed state may be hardly achieved. Therefore, when the gas pressure in the combustion chamber is higher than the gas pressure in the crank case, the gas may reversely flow from the combustion chamber through the gap between the crank and the crank case wall to the crank case. As a result, the gas pressure in the combustion chamber can be hardly increased and thus the working efficiency of the engine cannot be enhanced.

SUMMARY OF THE INVENTION

It is therefore a primary object of the present invention to provide a turbo-boosting, mechanism specifically for two-stroke engine for increasing the power of the engine.

It is a further object of the present invention to provide the above boosting mechanism which has simple components and is manufactured at low cost.

According to the above objects, the boosting mechanism of two-stroke engine of the present invention includes a mandrel of an activating shaft and a turbo-propeller. The turbo-propeller has a circular tray structure formed with a central hole. Multiple arched vanes radially extend from a circumference of the central hole to a rim of the circular tray. A body of the circular tray of the turbo-propeller is disposed with an engaging structure. The mandrel of the activating shaft is passed through the central hole of the turbo-propeller for coupling the turbo-propeller with the activating shaft. The engaging structure is coupled with the crank in the crank case. The turbo-propeller is positioned in front of the intake of the combustion chamber.

When rotating the activating shaft, the turbo-propeller is rotated along with the activating shaft to sweep relatively much gas into the combustion chamber so as to increase the gas pressure in the combustion chamber. By means of driving of the crank the gas is continuously swept into the combustion chamber without reversely flowing. Therefore, the gas pressure in the combustion chamber can be maintained to increase the power of the engine.

The present invention can be best understood through the following description and accompanying drawings wherein:

DETAILED DESCRIPTION OF THE PREFERRED EMBODIMENT

Figure 1:
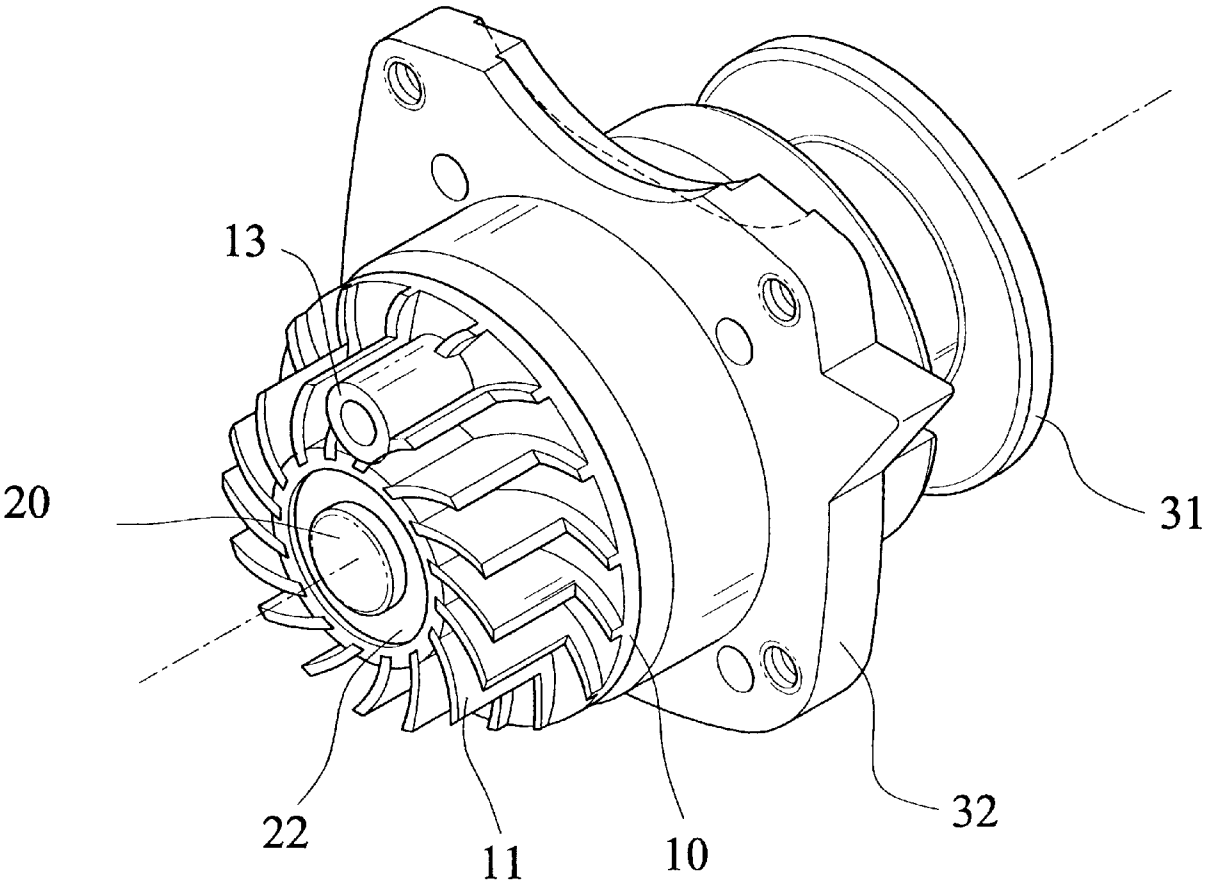
FIG. 1 is a perspective assembled view of a preferred embodiment of the present invention.
Figure 2:
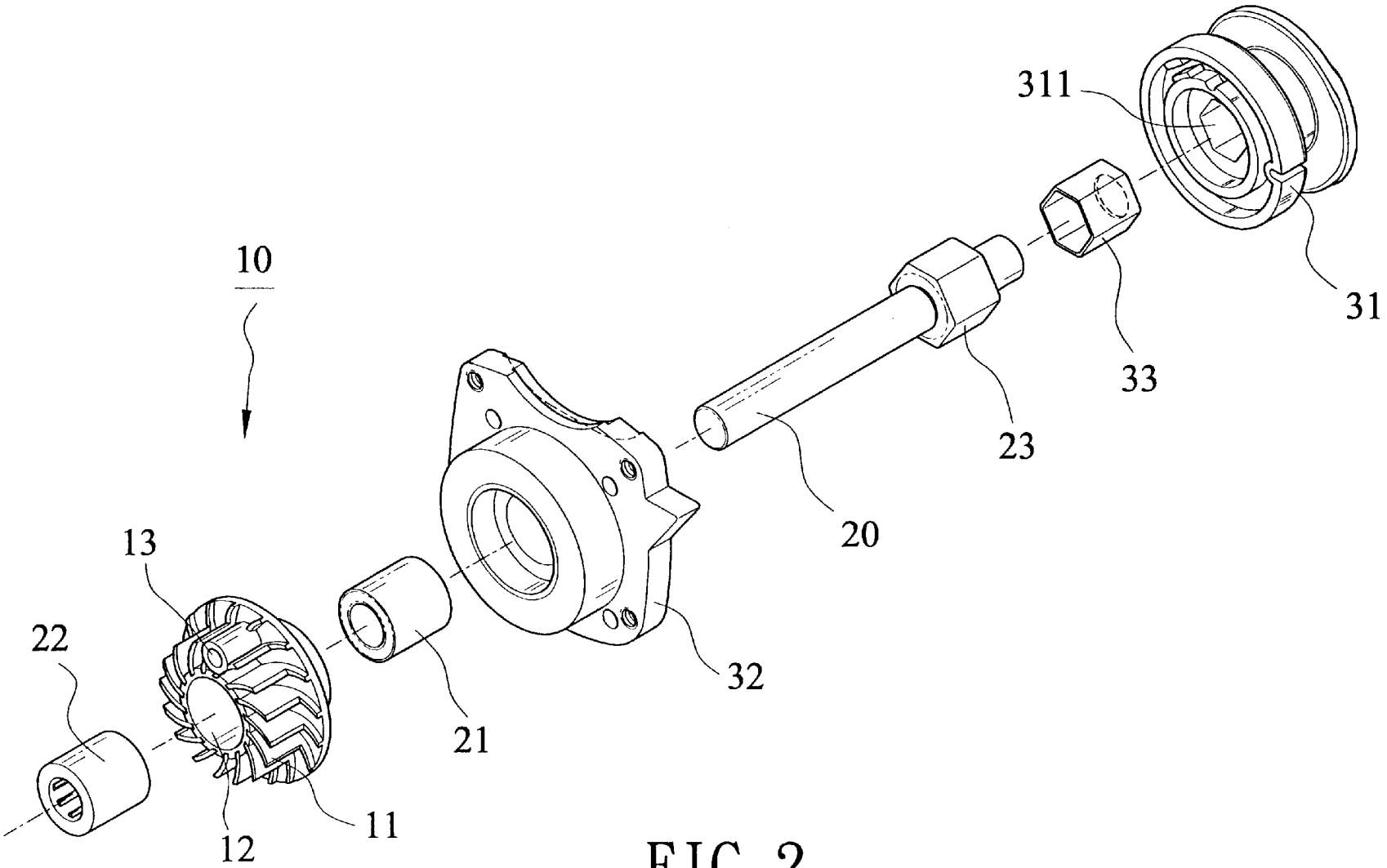
FIG. 2 is a perspective exploded view of the embodiment of FIG. 1.

Please refer to FIGS. 1 and 2. The boosting mechanism of the two-stroke engine of the present invention includes a turbo-propeller 10 and a mandrel 20. A rear end of the mandrel 20 is disposed with a hexagonal body 23. A sleeve 21 is fitted on the mandrel 20 in front of the hexagonal body 23. A front end of the mandrel 20 is disposed with a one-way bearing 22.

Figure 3B:
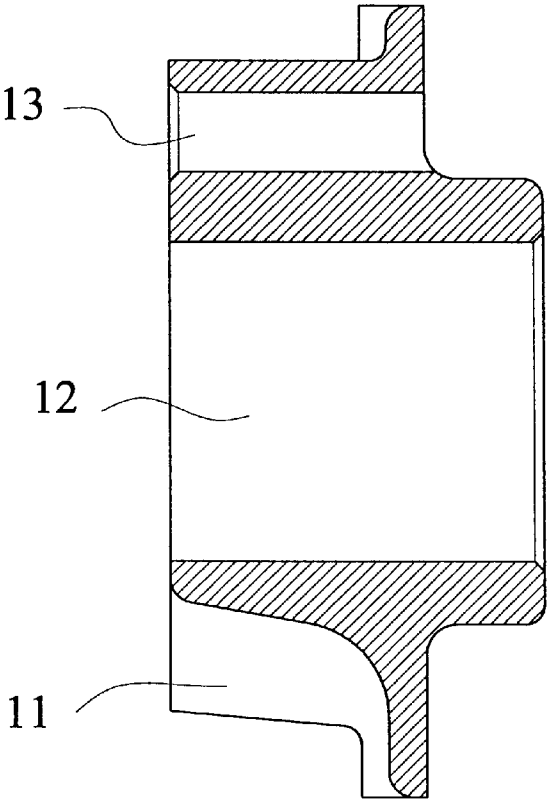
FIG. 3B is an axially sectional view of the turbo-propeller of the present invention.
Figure 3A:
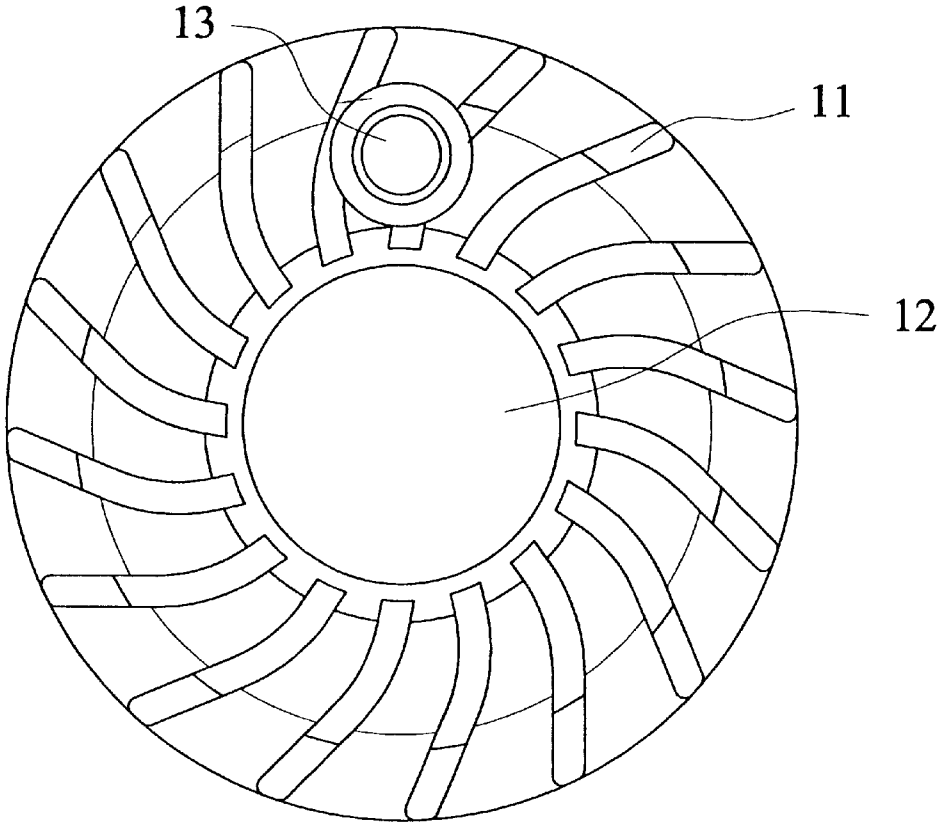
FIG. 3A is a front view of the turbo-propeller of the present invention.

Referring to FIGS. 3A and 3B, the turbo-propeller 10 is a circular tray formed with a central hole 12. Multiple vanes 11 radially extend from the circumference of the central hole 12 to the rim of the circular tray. Each vane 11 is arched in a clockwise direction. The body of the turbo-propeller 10 is disposed with an engaging structure 13.

Referring to FIGS. 1 and 2, the boosting mechanism further includes an activating rotary switch 31 which is an annular structure formed with a central hexagonal insertion socket 311, and a partitioning plate 32 which is a substantially rectangular plate structure formed with a central hole.

Figure 4:
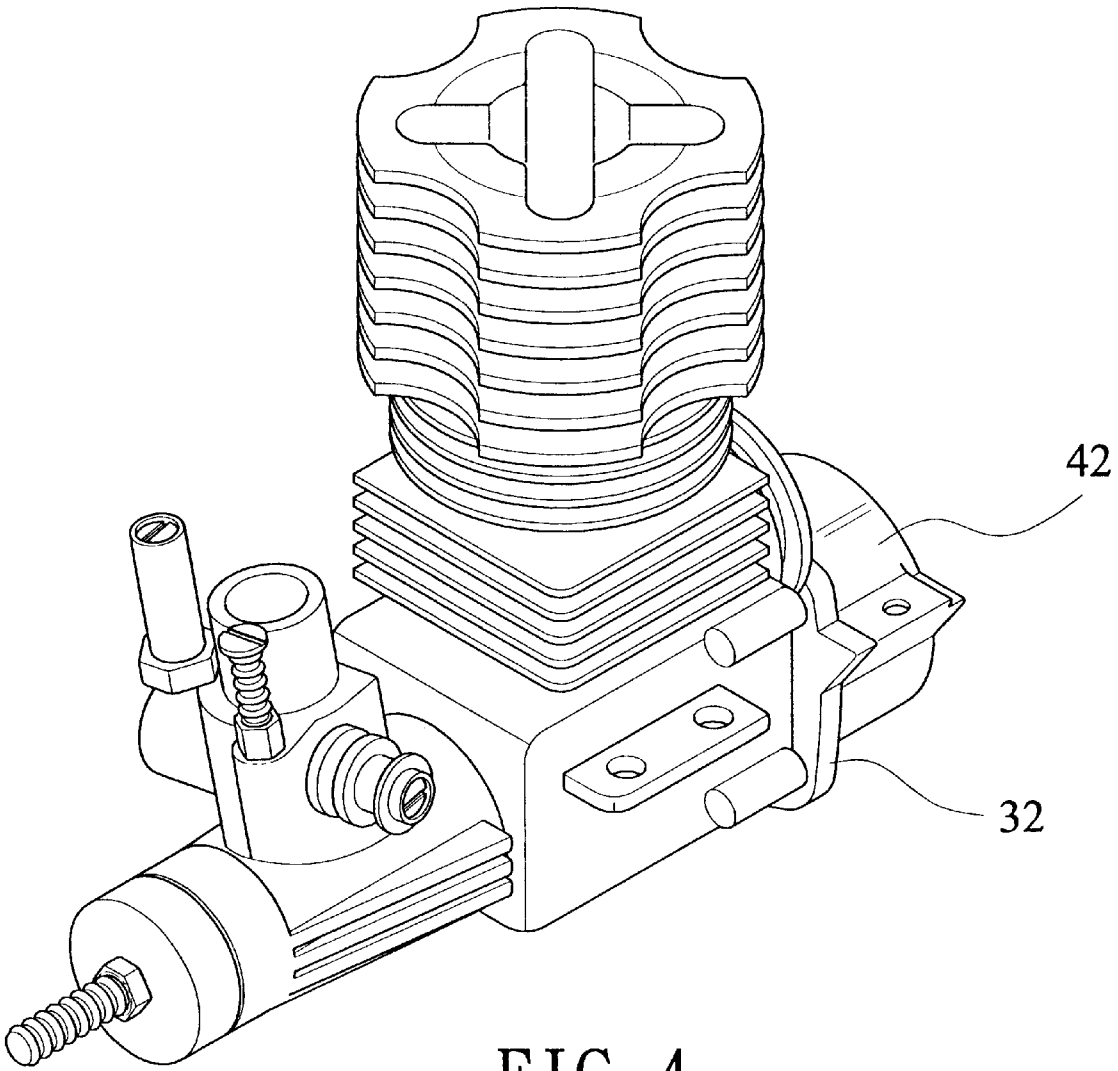
FIG. 4 is a perspective assembled view showing that the present invention is installed on a toy car engine.
Figure 5:
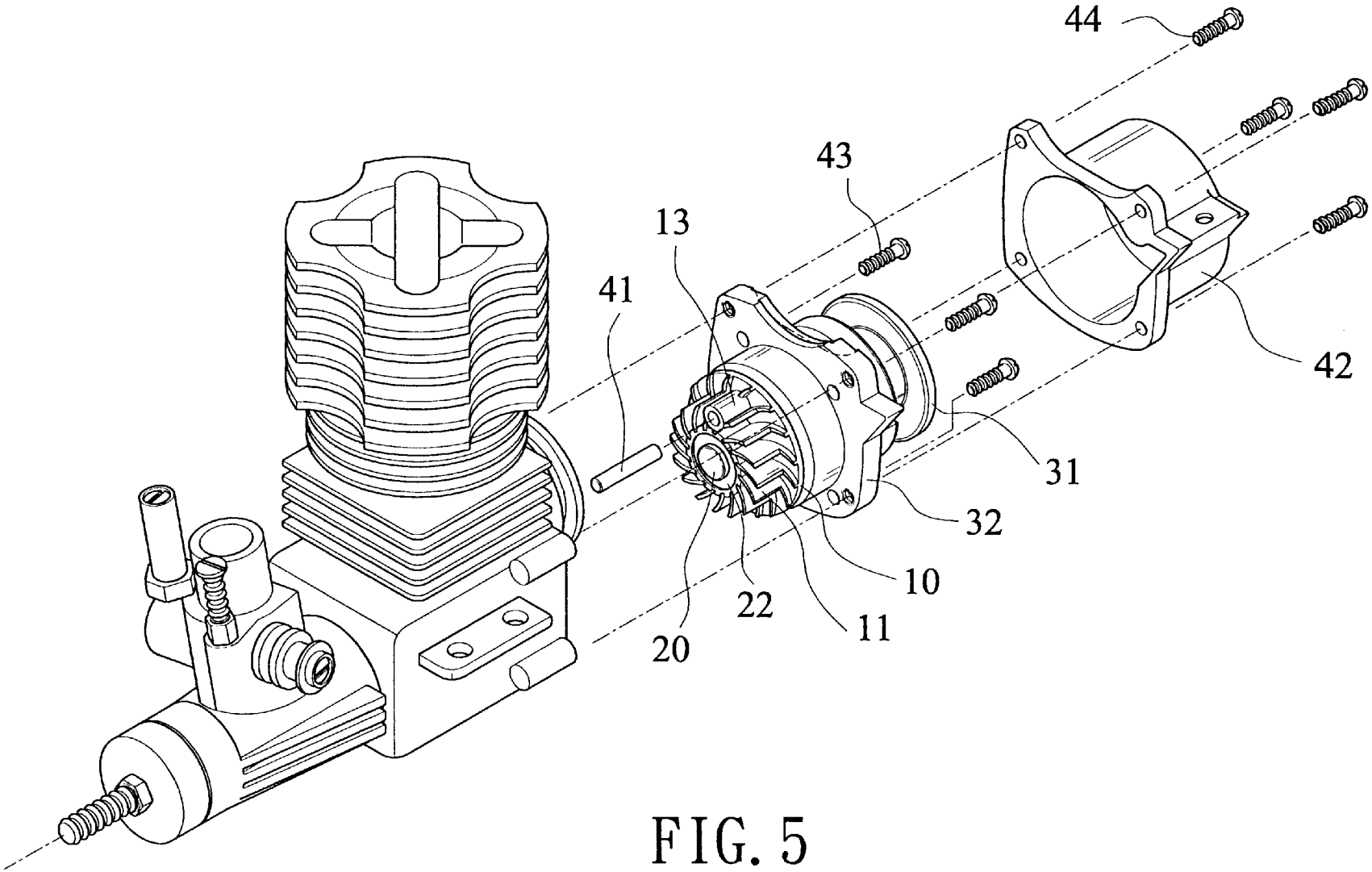
FIG. 5 is a perspective exploded view according to FIG. 4.
Figure 6:
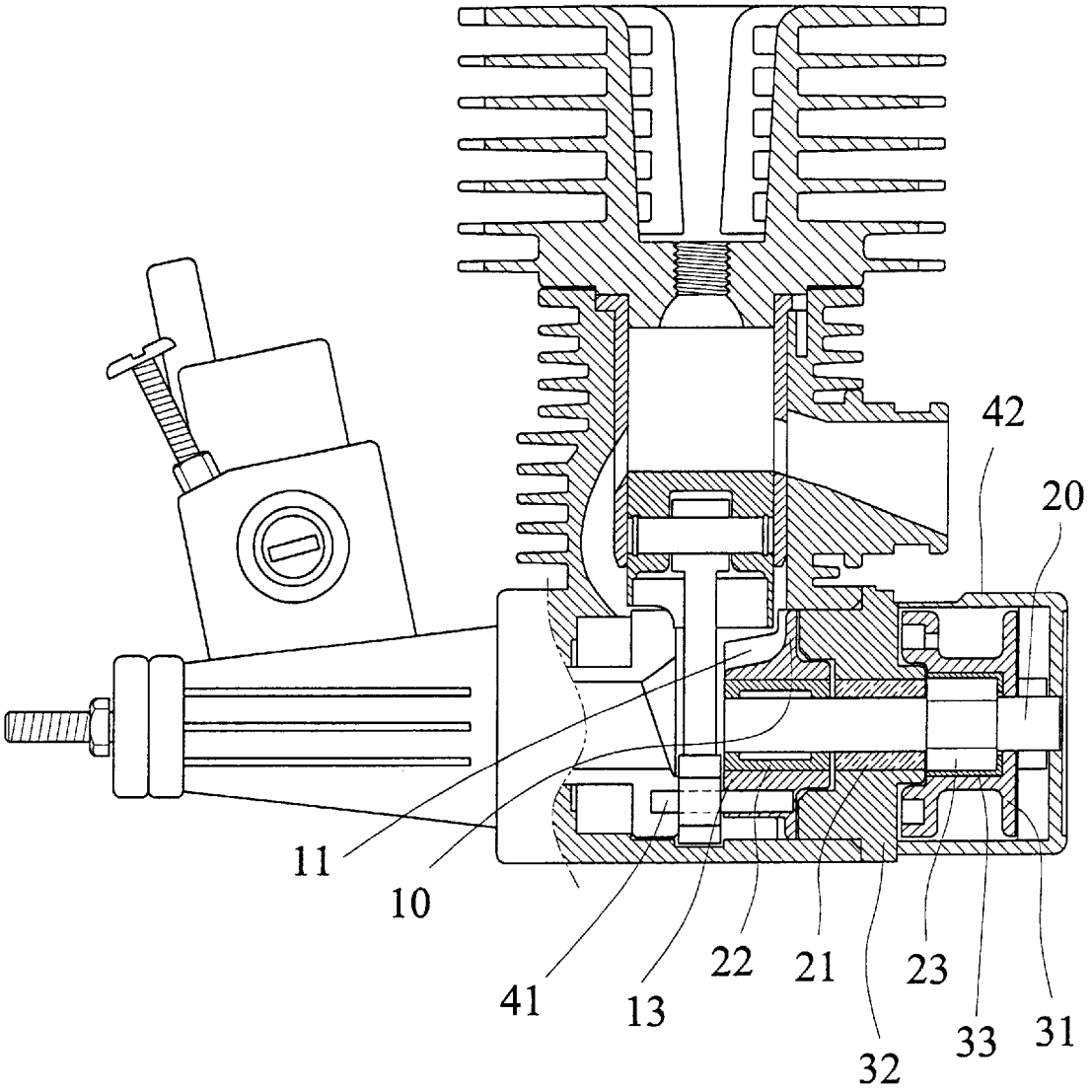
FIG. 6 is a sectional view according to FIG. 4.

The hexagonal body 23 at the rear end of the mandrel 20 via a hexagonal collar is inserted into the hexagonal socket 311 so as to integrally combine the mandrel with the rotary switch 31. The sleeve 21 of the mandrel 20 is positioned in the cent hole of the partitioning plate 32, whereby the mandrel 20 is rotatably disposed on the partitioning plate 32 with the rotary switch 31 attaching to the partitioning plate 32. The one-way bearing 22 serves to connect the mandrel 20 with the turbo-propeller 10 and restrict the rotational direction of the mandrel 20 and the turbo-propeller 10 to avoid reverse operation thereof Referring to FIGS. 4 to 6, in the case that the present invention is applied to the engine of a model car, a pin member 41 is serially passed through the engaging structure 13 of the turbo-propeller 10 and a crank 50 so as to connect the turbo-propeller 10 with the crank 50 in front of the intake port of the combustion chamber. Several bolts 43 are passed through the partitioning plate 32 to secure the respective components on the casing of the engine. In addition, several bolts 44 are used to lock a housing 42 on outer side of the rotary switch 31 to enhance the appearance and facilitate operation.

Figure 7:
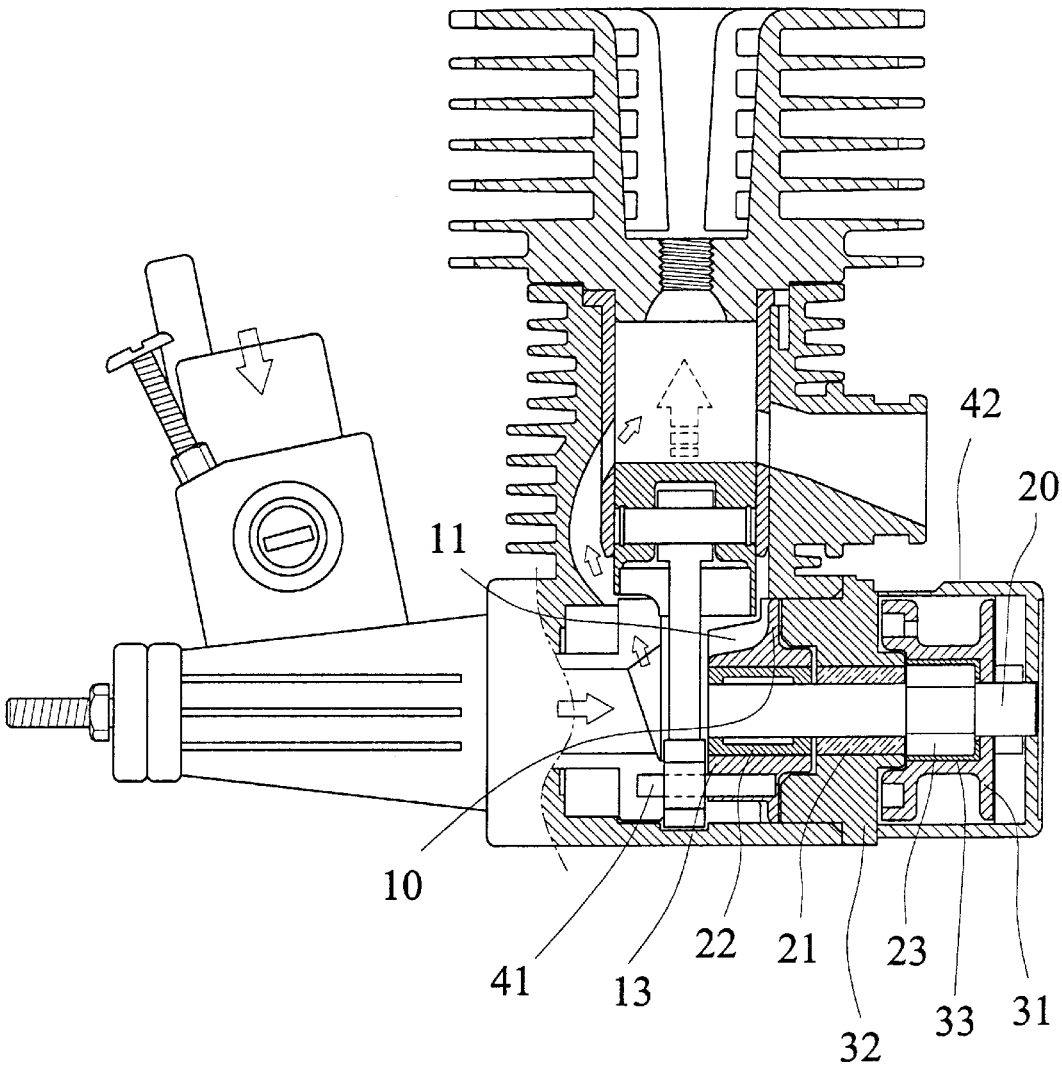
FIG. 7 shows the flowing path of the working gas in operation.

When activated, the mandrel 20 is rotated to rotary drive the turbo-propeller 10. The vanes 11 sweep the working gas into the combustion chamber to rotary drive the crank 50. After activated, the crank 50 drives the turbo-propeller 10 to rotate, whereby during operation of the engine, the turbo-propeller 10 continuously rotates and uninterruptedly sweeps the gas into the combustion chamber. The room of the combustion chamber is limited, while the turbo-propeller 10 sweeps relatively much gas into the combustion chamber without interruption. Therefore, the gas pressure in the combustion chamber is increased so as to increase the power of the engine as shown in FIG. 7.

According to the above arrangements, the present invention has simple components and small volume, while effectively increasing the power of the engine. The above embodiment is only used to illustrate the present invention, not intended to limit the scope thereof. Many modifications of the above embodiment can be made without departing from the spirit of the present invention.

What is claimed is:

1. A boosting mechanism of two-stroke engine, comprising a turbo-propeller and a mandrel with front and rear ends, the rear end of the mandrel being coupled with an activating rotary switch, the front end of the mandrel being coupled with the turbo-propeller, the turbo-propeller being disposed in front of an intake port of the combustion chamber of an engine, the turbo-propeller having a circular tray structure formed with a central hole and multiple vanes radially extending from a circumference of the central hole to a rim of the circular tray, and a body of the circular tray of the turbo-propeller being disposed with an engaging structure for securing the turbo-propeller on the engine.

2. The boosting mechanism of two-stroke engine, wherein the rear end of the mandrel has a hexagonal body and the rotary switch has a hexagonal socket for receiving the hexagonal body of the mandrel together with a hexagonal collar.

3. The boosting mechanism of two-stroke engine, wherein a pin member is connected to the engaging structure for serial connection to a piston of an engine.

4. The boosting mechanism of two-stroke engine, wherein a one-way bearing is disposed between the turbo-propeller and the mandrel to prevent the turbo-propeller and the mandrel from rotating in different directions.

* * * * *